United States Patent [19]

Keydel

[11] 4,371,875

[45] Feb. 1, 1983

[54] PROJECTILE ANTENNA

[75] Inventor: Wolfgang Keydel, Ulm, Fed. Rep. of Germany

[73] Assignee: Licentia Patent-Verwaltungs-GmbH, Frankfurt am Main, Fed. Rep. of Germany

[21] Appl. No.: 623,557

[22] Filed: Oct. 20, 1975

[30] Foreign Application Priority Data

Oct. 22, 1974 [DE] Fed. Rep. of Germany ..... 2450063

[51] Int. Cl.[3] ..... H01Q 1/28

[52] U.S. Cl. ..... 343/708; 343/792

[58] Field of Search ..... 343/705, 708, 790, 791, 343/807; 102/70.2 P

[56] References Cited

U.S. PATENT DOCUMENTS 2,513,157 6/1950 Ferris et al. ..... 343/705

2,947,255 8/1960 Kuck et al. ..... 102/70.2 P 3,475,755 10/1969 Bassen et al. ..... 343/705

*Primary Examiner*—Theodore M. Blum

*Attorney, Agent, or Firm*—Spencer & Kaye

[57] ABSTRACT

An antenna for an electronic projectile detonator. A desired antenna pattern which is rotationally symmetrical to the longitudinal axis of the projectile is produced by designing the antenna as a dipole which is fed via a coaxial line and which is decoupled from the feeder line by a λ/4 wave trap. The dipole is realized by a frustoconical widened portion of an extension of the inner conductor of the coaxial feeder line, which widened portion constitutes the detonator head in the tip of the projectile and coincides, as regards position and direction, with the longitudinal axis of the projectile at the feed point of the antenna, and the wave trap which is also designed to be rotationally symmetrical to the longitudinal axis of the projectile.

5 Claims, 4 Drawing Figures

PROJECTILE ANTENNA

BACKGROUND OF THE INVENTION

The present invention relates to a projectile antenna. More particularly, the present invention relates to an antenna for an electronic projectile detonator.

SUMMARY OF THE INVENTION

It is the object of the invention to provide a projectile antenna which is distinguished by small space requirement yet has a bandwidth which is sufficient for practical application and an antenna diagram which is rotationally symmetrical to the longitudinal axis of the projectile and is independent of any possible torque of the projectile.

The above object is achieved according to the present invention in that the antenna is designed as a dipole which is fed through a coaxial line and decoupled from its feeder line by means of a $\lambda/4$ wave trap ($\lambda$=operating wavelength) so that the dipole is realized by a $\lambda/4$ frustoconical widened portion of an extension of the inner conductor of the feeder line, which coincides at the feed point, with respect to position and direction, with the longitudinal axis of the projectile at the feed point, with the widened portion constituting the detonator head in the tip of the projectile and by the wave trap which is also designed to be rotationally symmetrical to the longitudinal axis of the projectile, and includes a conductive $\lambda/4$ sleeve extending from the feed point around said coaxial feed line and connected to the outer conductor of the feed line only at the feed point.

It is particularly advisable to structurally combine the wave trap of the antenna according to the present invention with the detonator radome.

With the configuration of the antenna as provided by the present invention there results a mutual decoupling between antenna and projectile body which leads to a substantial elimination of the influence of the projectile body on the shape of the directional diagram and the impedance of the antenna.

DETAILED DESCRIPTION OF THE PREFERRED EMBODIMENTS

Figure 1:
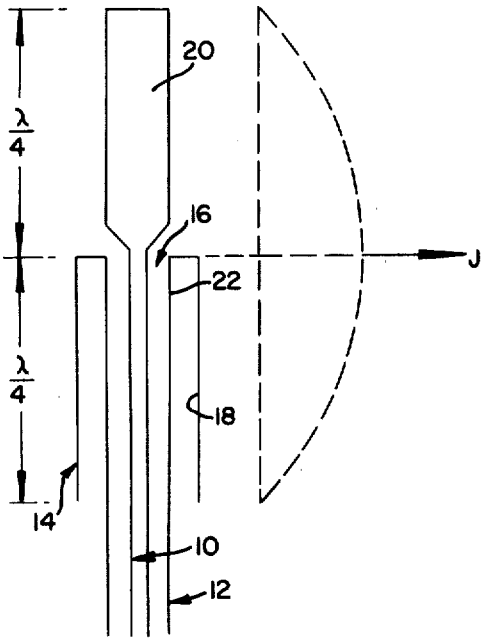
FIG. 1 is a schematic diagram of a dipole antenna of the type used according to the present invention.

FIG. 1 is a schematic view of a dipole antenna with a reflector, which is shown is dashed lines, which will be used to explain the invention. This dipole antenna is fed via a coaxial feeder line including an inner conductor 10 and an outer conductor sheath 12 and is decoupled from its feeder line 10–12 in order to prevent surface currents on the outer jacket or sheath 12 of the feeder line or cable. For the purpose of providing this decoupling the coaxial cable is surrounded with a conductive blocking sheath 14 which is connected with the outer conductor 12 of the coaxial cable only at the feed point 16 of the dipole antenna. The length of the blocking sheath 14 is $\lambda/4$ where $\lambda$ is the wavelength at the operating frequency of the antenna. Together with the surface of the cable sheath 12, the inner surface 18 of the blocking sheath 14 forms a short-circuited $\lambda/4$ line, i.e., a wave trap which forms an infinite resistance for the transfer currents from the radiator of the dipole antenna to cable sheath 12. The extension 20 of the inner conductor 10 of the coaxial feeder line together with the outer surface 22 of the blocking sheath 14 (of the wave trap) forms the radiating portion of the dipole antenna. If the radiator length is assumed to be $\lambda/4$, the input resistance at the point of connection of the cable, i.e., the feed point 16, is 73 ohm. The dipole antenna is decoupled from the projectile body in a principally similar manner.

Figure 2:
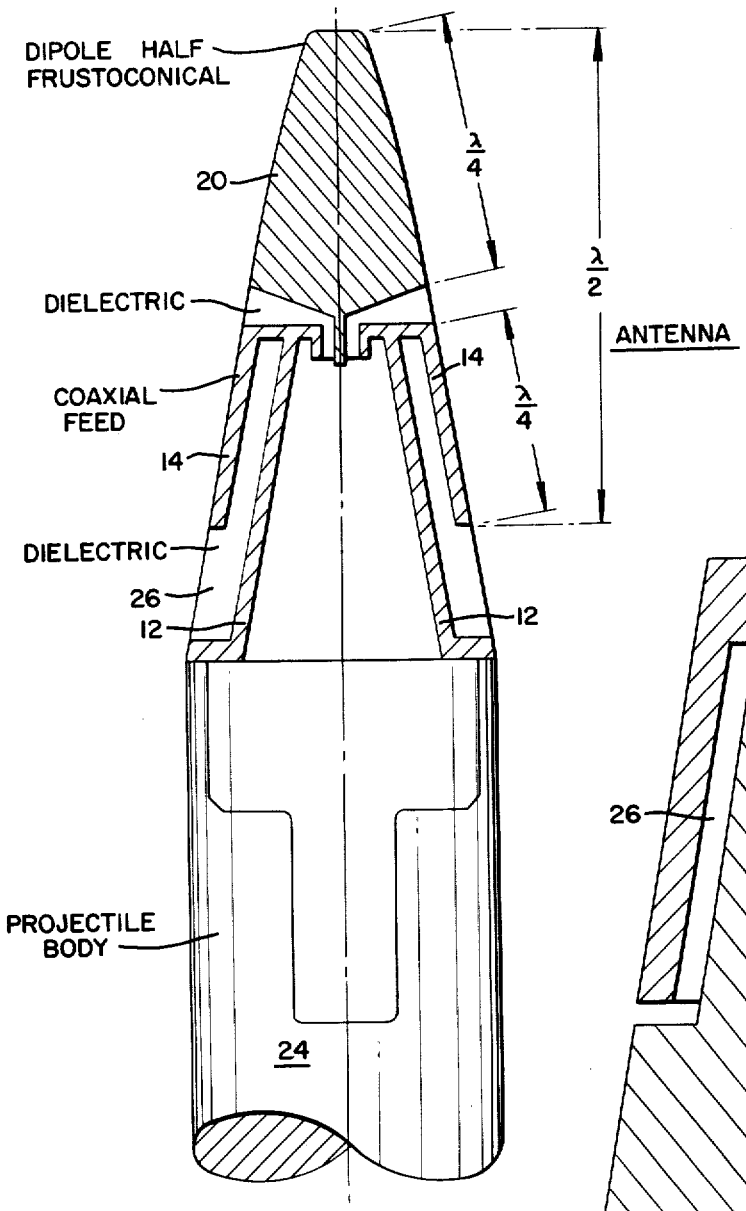
FIG. 2 is a longitudinal sectional view of one embodiment of the invention.

One embodiment according to the invention of the antenna arrangement schematically shown in FIG. 1 is shown in FIG. 2, in which the same numerals are utilized to identify the corresponding parts. The detuning sleeve required for decoupling is here shown exaggeratedly large for reasons of clarity. The dipole of the antenna of FIG. 2 is realized by a frustoconical, approximately $\lambda/4$ long widened portion 20 of the inner conductor 10 of the coaxial feed line in conjunction with the likewise $\lambda/4$ long sleeve 14 which forms the wave trap. As concerns position and direction, the inner conductor 10 coincides with the longitudinal axis of the projectile, a portion of which is shown at 24. The wave trap producing sleeve 14 is also designed to be rotationally symmetrical to the longitudinal axis of the projectile. The frustoconically widened portion 20, which forms a dipole half, is positioned in the tip of the projectile, as shown, and constitutes the detonator head. Additionally, the spaces between the cable sheath 12, the sleeve 14, and the frustoconically widened portion 20 are filled with a dielectric material 26 which constitutes the radome for the detonator.

Figure 3:
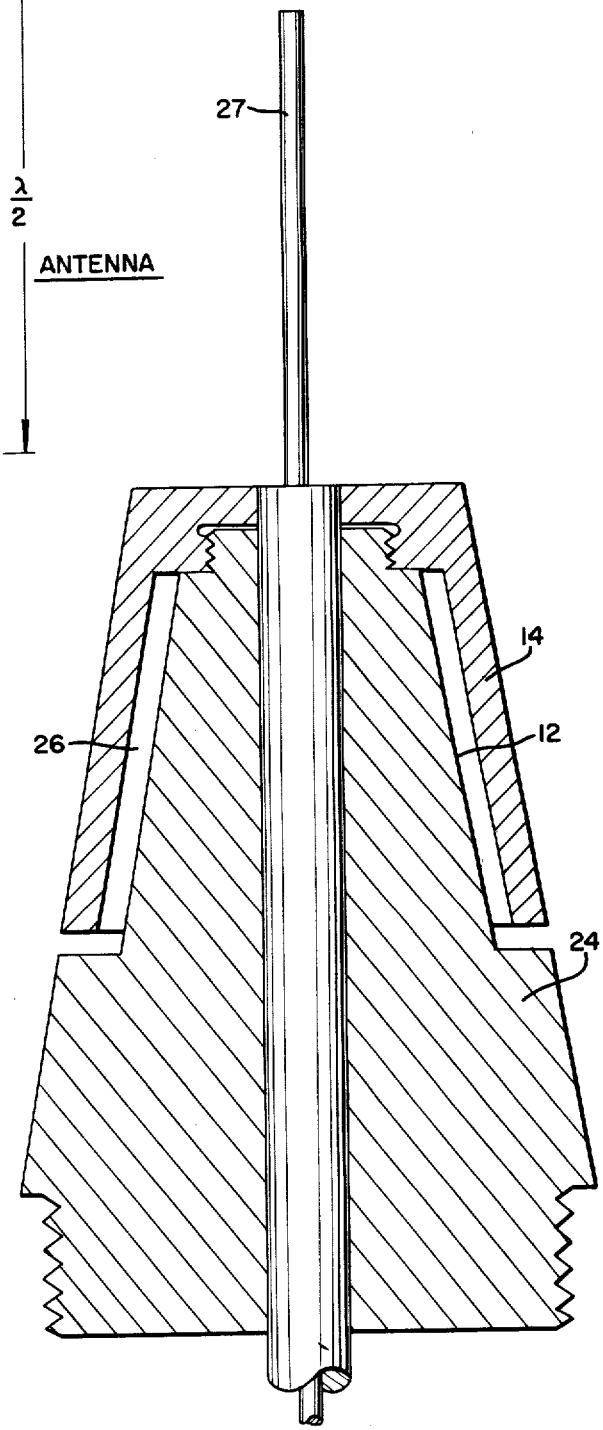
FIG. 3 is a longitudinal sectional view of another embodiment of the invention.

Another embodiment according to the invention of the antenna arrangement is shown in FIG. 3 in which the same numerals are utilized as in FIGS. 1 and 2 to identify the corresponding parts. The frustoconical, approximately $\lambda/4$ long widened position 20 of the inner conductor 10 of the embodiment according to FIG. 2 is substituted in FIG. 3 by an extension 27 of the inner concuctor 10 which is unwidened.

The length of this extension may be equal to $\lambda/4$, but can be optimised to any other length if it is necessary. This will be true in connection with other embodiments of the invention, too.

Figure 4:
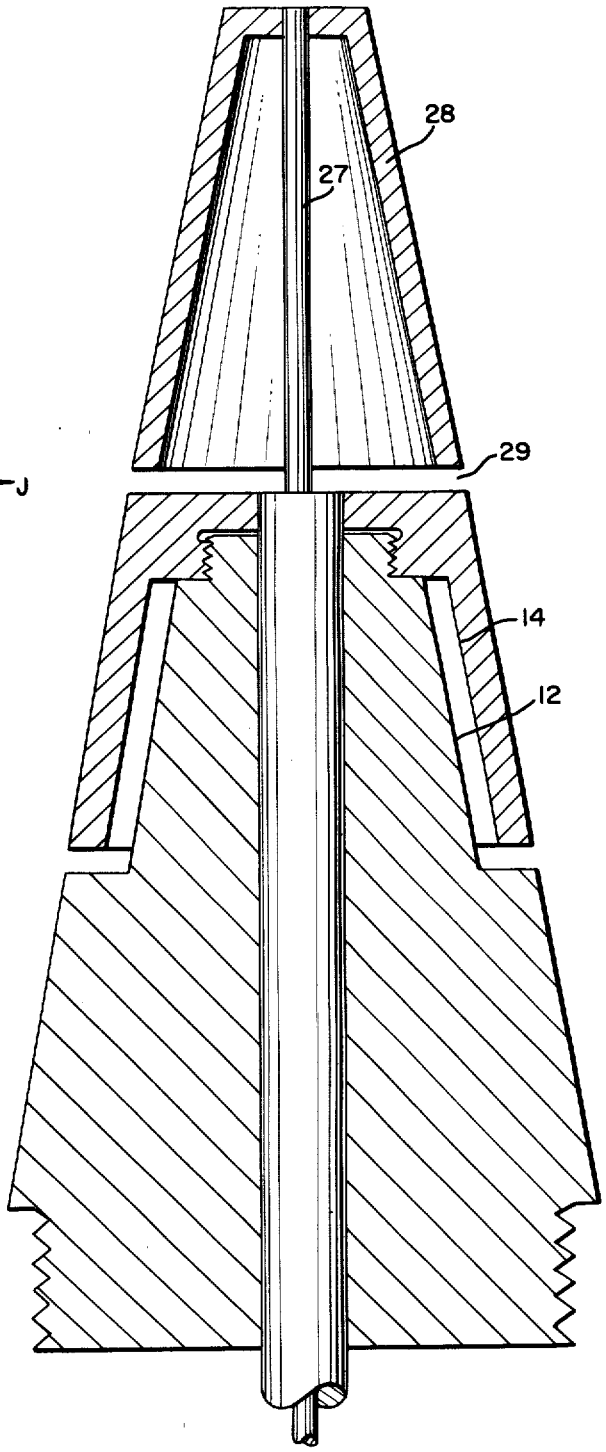
FIG. 4 is a longitudinal sectional view of a further embodiment of the invention.

A further embodiment according to the invention of the antenna arrangement it shown in FIG. 4, which is identical to the embodiment according to FIG. 3 with the extension of an additional microwave resonator comprising a frustoconical hollow number 28 connected to the end of the extension 27 and forming one circumferential slot 29. The slot 29 represents a circumferential ring-slot antenna and can be replaced by one or more other slots working in the same principal manner as one or more slot antennas.

The wave trap producing sleeve 14 can be conductively connected to the projectile body either with its upper end shown in FIGS. 1 through 4 or with its lower end.

It will be understood that the above description of the present invention is susceptible to various modifications, changes and adaptations, and the same are intended to be comprehended within the meaning and range of equivalents of the appended claims.

I claim:

1. An antenna for an electronic projectile detonator, with the antenna producing a desired antenna diagram which is rotationally symmetrical about the longitudinal axis of the projectile, said antenna comprising: a dipole which is fed through a coaxial feeder line and decoupled from said feeder line by means of a λ/4 wave trap (λ= operating wavelength), said dipole and said wave trap being realized by a frustoconical widened portion of a λ/4 extension of the inner conductor of the feeder line which coincides, as regards position and direction, with the longitudinal axis of the projectile at the feed point, said widened portion constituting the detonator head in the tip of the projectile, and a λ/4 conductive sleeve which is rotationally symmetrical to the longitudinal axis of the projectile and surrounds said coaxial feeder line, and is connected to the outer conductor of said coaxial feeder line only at said feed point of said antenna.

2. An antenna as defined in claim 1 including a radome for said antenna; and wherein said wave trap is structurally combined with said radome.

3. An antenna for an electric projectile detonator, with the antenna producing a desired antenna diagram which is rotationally symmetrical about the longitudinal axis of the projectile, said antenna comprising: a dipole which is fed through a coaxial feeder line and decoupled from said feeder line and the projectile body by means of a λ/4 wave trap (λ= operating wavelength), said dipole and said wave trap being realized by an extension of the inner conductor of the feeder line which coincides, as regards position and direction, with the longitudinal axis of the projectile at the feed point, and a λ/4 conductive sleeve which is rotationally symmetrical to the longitudinal axis of the projectile and surrounds said coaxial feeder line, and is conductively connected to the outer conductor of said coaxial feeder line only at said feed point of said antenna.

4. An antenna as defined in claim 3 wherein said extension of the inner conductor is constituted by λ/4-extension.

5. An antenna for an electric projectile detonator, with the antenna producing a desired antenna diagram which is rotationally symmetrical about the longitudinal axis of the projectile, said antenna comprising: a dipole which is fed through a coaxial feeder line and decoupled from said feeder line and the projectile body by means of a λ/4 wave trap (λ= operating wavelength), said dipole and said wave trap being realized by a frustoconical widened portion of an extension of the inner conductor of the feeder line which coincides, as regards position and direction, with the longitudinal axis of the projectile at the feed point, said widened portion constituting the detonator head in the tip of the projectile, and a λ/4 conductive sleeve which is rotationally symmetrical to the longitudinal axis of the projectile and surrounds said coaxial feeder line, and is conductively connected to the outer conductor of said coaxial feeder line only at said feed point of said antenna.

* * * * *